United States Patent [19]

Saito

[11] Patent Number: 4,749,826

[45] Date of Patent: Jun. 7, 1988

[54] SWITCH ASSEMBLY

[76] Inventor: Takashi Saito, Parkside Mansion, Suite 302, 29-4 Kumano-cho, Itabashi-ku, Tokyo, Japan

[21] Appl. No.: 55,496

[22] Filed: May 29, 1987

[30] Foreign Application Priority Data

May 29, 1986 [JP] Japan ..... 61-80208[U]

[51] Int. Cl.[4] ..... H01H 25/04

[52] U.S. Cl. ..... 200/6 A

[58] Field of Search ..... 200/6 A, 17 R, 18, 153 K, 200/153 T

[56] References Cited

U.S. PATENT DOCUMENTS

| | | | |
|---|---|---|---|
| 3,708,636 | 1/1973 | Sobchak | 200/6 A |
| 4,181,827 | 1/1980 | Diepeveen | 200/6 A |
| 4,382,166 | 5/1983 | Kim | 200/6 A |
| 4,415,782 | 11/1983 | Elmberg | 200/6 A |
| 4,476,320 | 9/1984 | Kim | 200/6 A X |
| 4,479,038 | 10/1984 | Marhold et al. | 200/6 A |
| 4,538,035 | 8/1985 | Pool | 200/6 A |

*Primary Examiner*—J. R. Scott

*Attorney, Agent, or Firm*—Schwartz & Weinrieb

[57] ABSTRACT

A switch assembly according to the present invention for operating a television game machine comprises a base member provided with a through hole, an operating rod extending through the through hole and pivotally supported by the base member, a plurality of automatic-reset switches operated by receiveing a pressing force from the operating rod when the rod is pivoted, a spring for returning the operating rod to its position before pivoting and a plate disposed on the base member and rotatable about the axis of the through hole. The plate has a hole, through which the operating rod extends. The hole is defined by a hole edge portion for regulating the range of the pivotal movement of the operating rod so as to permit the operation of either one switch when the plate is set at a specified position and to permit the operation of either one or two adjacent switches when the plate is located at another position.

20 Claims, 3 Drawing Sheets

SWITCH ASSEMBLY

BACKGROUND OF THE INVENTION

1. Field of the Invention

This invention relates to a switch assembly for a television game machine.

2. Description of the Prior Art

A switch assembly is disposed in a television game machine as one of the mechanisms for varying the image of the game so as to progress the game.

The switch assembly is provided with a plate base member having a through hole and an operating rod extending through the through hole of the base member and supported pivotally by the base member. A plurality of automatic-reset switches having respective actuators are mounted on the base member such that the actuators are angularly and uniformly spaced apart along a circular locus having a center on the axis of the through hole. Either one or two adjacent actuators are capable of selectively receiving a pressing force of the operating rod so as to actuate the corresponding switch or switches when the operating rod is pivoted. A spring surrounding the operating rod is disposed so as to be compressed and exerted thereby exert a spring force on the base plate and the operating rod when the operating rod is pivoted. A plate having a hole through the operating rod extends is threadedly fastened to the base member.

The switch assembly which is subjected to a required wiring pattern relative to the switches is installed on a frame of the television game machine so to expose one end of the operating rod to the outside of the game machine. Thus, the operating rod may be operated from the outside of the television game machine so as to pivot the other end of the operating rod so as to actuate at least one of the switches.

The switches to be operated are determined according to the content of the television game. Accordingly, the shape of the hole provided on the plate for regulating the distance to permit pivoting of the operating rod is determined.

Conventionally, a plurality of plates each having a required hole configuration have been prepared. When the content of the game is changed, a previously installed plate is removed so as to install a different plate. More specifically, in the case of four switches, when it is necessary to selectively operate either one of the switches, a plate having a cross-shaped hole is used as the plate. In this case, the plate is secured so as to dispose portions of the hole extending in four directions toward respective actuators of the four switches. Furthermore, when it is necessary to selectively operate either one or two adjacent switches, a plate having a hole provided with four other hole portions between the cross-shaped hole portions extending in the four directions is used. In this case, the plate is secured so as to dispose the former hole portions extending in the four directions toward respective actuators of the four switches and to dispose the latter hole portions toward respective sides between the adjacent actuators. In either case, the pivoting distance of the operating rod is regulated by means of the hole portions, whereby a required switch or switches are actuated.

However, the content of the game of the television game machine has been frequently changed with respect to a plurality of television game machines at once. Furthermore, it is necessary to change the game content at relatively frequent intervals according to player selections. With a prior art switch assembly, in which a plurality of screws had to be removed and refastened for every plate, a great deal of time and labor were necessary for exchanging the plates.

OBJECT OF THE INVENTION

It is an object of the present invention to reduce the necessity for exchanging the plates as much as possible, thereby alleviating the time and labor necessary for exchanging the plates.

SUMMARY OF THE INVENTION

According to the present invention, a switch assembly for a television game machine comprises a base member having a through hole, an operating rod extending through the through hole of the base member and pivotally supported by the base member, a plurality of automatic-reset switches having respective actuators, the actuators being angularly and uniformly spaced apart along a circular locus having a center on the axis of the through hole, either one or two adjacent actuators being capable of receiving a pressing force from the operating rod so as to actuate the corresponding switch or switches when the operating rod is pivoted, a spring surrounding the operating rod and disposed so as to be compressed and thereby exert a spring force on the base member and operating rod when the operating rod is pivoted, and a plate having a hole through which the operating rod extends and rotatably mounted on the base member about the axis of the operating rod. The hole of the plate is defined by a first hole edge permitting pivoting of the operating rod such that either one of the actuators receives the pressing force of the operating rod so as to actuate the corresponding switch when the plate is set at a first angular position, and also a second hole edge portion permitting the pivoting of the operating rod such that either one or two adjacent actuators receive the pressing force of the operating rod so as to actuate the corresponding switch or switches when the plate is rotated through a predetermined angle from the first position to a second position.

According to the present invention, the plate is rotatable and provided with the hole defined by the hole edges which are capable of regulating the pivoting distance of the operating rod such that either one of the plurality of switches is selectively operated when the plate is disposed at the specified position and either one or two adjacent switches are operated when the plate is disposed at the other position, in which the plate is rotated through a predetermined angle from the specified position. Therefore, when two operational modes of the switch are changed from one mode to the other accompanying a change of game contents of the television game machine, the plate may be rotated through predetermined angle without replacement. The operation for rotating the plate may be done easily in a short period of time, compared with the case when replacing the plate is necessary, since the plate need not be completely removed from the base member.

The two operational modes of the switch are different depending on the number of switches. The switch assembly having four switches is predominantly used for the television game machine. Accordingly, when a hole adapting to the operation of four switches is provided on the plate, it is possible to cope with most changes in game contents.

BRIEF DESCRIPTION OF THE DRAWINGS

The other objects and features of the invention will become apparent from the following description of a preferred embodiment of the invention with reference to the accompanying drawings, in which.

DETAILED DESCRIPTION OF THE PREFERRED EMBODIMENT

Figure 1:
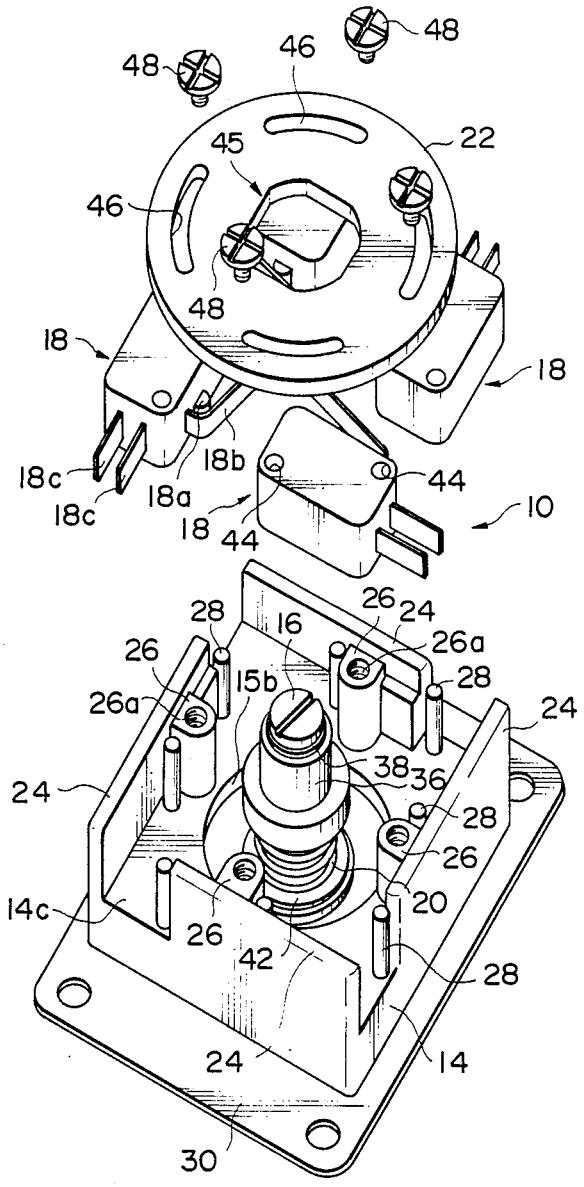
FIG. 1 is an exploded perspective view showing a switch assembly according to the present invention.

Referring to FIG. 1, a switch assembly 10 according to the present invention comprises a base member 14 having a through hole 12 (See FIG. 2), an operating rod 16, a plurality of automatic-reset switches 18, a spring member 20 and a plate 22.

Figure 2:
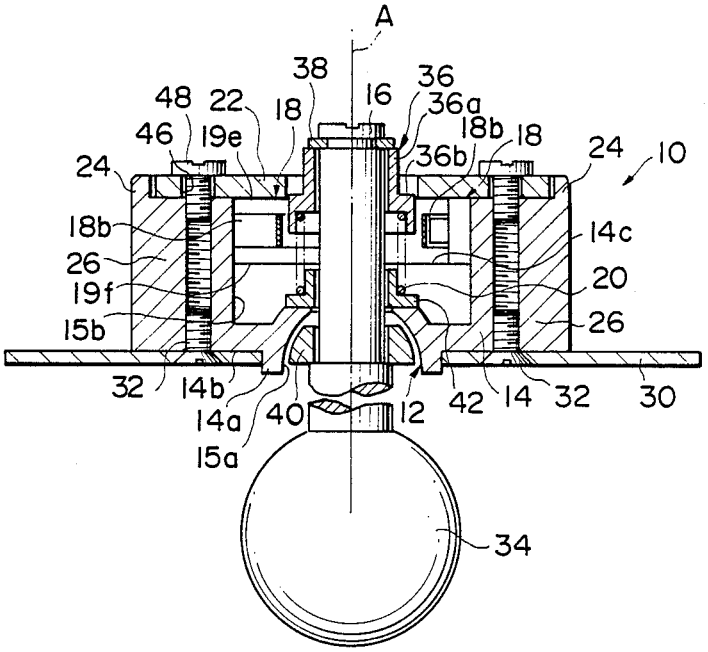
FIG. 2 is a longitudinal sectional view showing the switch assembly.

The base member 14 presents a rectangular shape as a whole and is formed at a central portion thereof with a cup-like support portion **14*a* for supporting the operating rod 16 as shown in FIG. 2. The support portion 14*a* has a hole 15*a* which opens to a lower surface 14*b* of the base member 14 and to an upper surface 14*c* opposite the lower surface, the lower open end being projecting slightly below the lower surface 14*b* of the base member 14. An inner surface of the support portion 14*a* for defining the hole 15*a* is constituted from part of a relatively smooth spherical surface. The bore of the lower open end of the support portion 14*a* is greater than that of the upper open end. Furthermore, the base member 14 is provided with a large-diameter hole 15*b* which opens to the upper surface 14*c*, surrounds the upper open end of the support portion 14*a* and communicates with the hole 15*a* of the support portion. Both holes 15*a* and 15*b* constitute the through hole 12. The base member 14** may be molded from a plastic material, for example.

A wall 24 integrally formed with the base member 14 is provided at each side edge of the base member. Each wall 24 extends from one corner of each side edge of the base member 14 in the longitudinal direction toward the other corner and ends short of the other corner. Each wall 24 extends orthogonally to the upper surface **14*c* of the base member 14 and serves as a shield for protecting the switches 18** disposed within the space surrounded by the walls.

A pillar-like spacer 26 extending from the upper surface **14*c* of the base member 14 is provided at the substantially central portion of each side edge of the base member 14. Each spacer 26 is integrally formed with the wall 24. The height of the spacer is smaller than that of the sidewall 24 by an amount corresponding to the thickness of the cover plate 22. A screw hole 26*a* extending through each spacer 26 in the longitudinal direction thereof is provided within each spacer 26**.

A pair of supports 28 extending parallel to the spacers 26 and upwardly from the upper surface **14*c* of the base member 14 are provided so as to be spaced from each other and are integral with the base member 14**.

A rectangular mounting plate 30 is mounted on the base member 14 in contact with the lower surface **14*b*. The mounting plate 30 having holes at four corners of a rectangle is attached through means of screws 32 extending through the base member 14 from the lower surface 14*b* so as to be threaded into respective screw holes 26*a* of the spacers 26. The switch assembly 10 may be installed on a frame (not shown) of the television game machine through means of the mounting plate 30**.

The operating rod 16 extends through the through hole 12 of the base member and is provided with a grip 34 on one side of the lower surface **14*b* of the base member and a tubular member 36 on the other side of the upper surface 14*c* of the base member. The tubular member 36 consists of a small-diameter tubular portion 36*a* contacting the pheripheral surface of the upper end of the operating rod 16 and a large-diameter tubular portion 36*b* extending from the lower end of the small-diameter tubular portion toward the lower end of the operating rod 16. An E-ring 38 is attached to the operating rod 16 at the upper end thereof. The E-ring prevents the tubular member 36 from coming off of the upper end of the operating rod 16**.

The operating rod 16 is pivotably supported upon the base member 14 through means of a bearing 40 mounted upon rod 16 between the opposite ends of the rod and spherically interfacing with the support portion **14*a* of the base member 14. Furthermore, a tubular sliding member 42 is attached to the operating rod 16 so as to slide in the longitudinal direction thereof and contact the upper open end of the support portion 14*a*. The bearing 40 is disposed at a mounting position upon rod 16 such that the upper end of the operating rod 16 projects above the top surface of the sidewalls 24**.

The spring member 20 consisting of a coil spring surrounds the operating rod 16 so as to be disposed between the tubular member 36 and the sliding member 42 in a slightly compressed state, the opposite ends of the spring member contacting the large-diameter tubular portion **36*b* of the tubular member 36 and the sliding member 42, respectively. The operating rod 16 is biased by means of the spring member 20 so as to be coaxial with the axis A of the through hole 12 of the base member 14. Furthermore, when horizontal force is applied to the ball end 34 of the operating rod 16 so as to pivot the upper end thereof, the spring member 20 is further compressed and the spring force is exerted on the base member 14 and operating rod 16 through means of the support portion 14*a* and E-ring 38. At this time, the spring force acts on the operating rod 16** so as to return the rod to its initial position before being pivoted.

Four switches are shown in the drawing, each of the switches constituting a microswitch. The number of switches 18 is set according to the content of the television game. Each switch 18 having a rectangular parallelepiped housing has a push button **18*a* projecting from one side 19*a* (See FIG. 3) of the housing and arm-like actuator 18*b* having one end pivotally mounted upon side 19*a* and the other end being a free end. When the free end of each actuator 18*b* is pressed toward the side 19*a* of each housing, each actuator 18*b* respectively presses against the push button 18*a* at substantially the central portion thereof. When the push button 18*a* is pressed so as to be completely embedded within the housing, each actuator 18*b* is substantially parallel to the surface of the side 19*a*. When the push button 18*a* is completely depressed, the switch 18** is actuated so as to close or open a circuit in the switch.

When the pressing force against the actuator **18*b* is released, the push button 18*a* is automatically returned, thereby releasing the actuation of the switch 18. At this time, the free end of each actuator 18b is pivoted so as to increase the distance with respect to the side 19a. A pair of terminals 18c electrically connected with a body (not shown) of the television game machine project outwardly from another side 19b of the housing which is adjacent to the side 19a**.

The four switches 18 are disposed at four corners of the base member 14 so as to be in contact with the upper surface 14c thereof, with the side 19c of the housing, which is disposed opposite to the side 19a of the housing facing toward the sidewall 24, while another side 19d of the housing which is disposed opposite to the side 19b of the housing is disposed toward the spacer 26, respectively. Furthermore, the side 19b of the housing is in close contact with one side edge of the base member 14 and the terminals 18c project out from the base member 14.

With this arrangement of the switches 18, the free end of each actuator 18b of the four switches 18 is angularly and uniformly spaced apart about the axis A along a circular locus. In the embodiment shown, it substantially corresponds to the outer periphery of the large-diameter tubular portion 36b of the tubular member 36 of the operating rod in the non-pivotal state. The circular locus has a center on the axis A of the through hole 12 of the base member 14. Furthermore, before the plate 22 is mounted, the operating rod 16 is capable of pivoting in any radial direction about the axis A as a starting position. When the operating rod 16 is pivoted toward each actuator 18b, the particular actuator receives the pressing force of the large-diameter tubular portion 36b of the tubular member, thereby permitting the actuation of the switch 18 incorporating that particular actuator 18b therein. Still further, when the operating rod is pivoted toward the space between two adjacent actuators 18b, the two actuators simultaneously receive the pressing force of the large-diameter tubular portion 36b, thereby permitting the operation of two switches 18 having the particular actuators 18b incorporated therein. More specifically, either one or two adjacent actuators of the four actuators receive the pressing force of the operating rod 16, thereby permitting the operation of the corresponding switch or switches 18.

As shown in the illustrated embodiment, the height of each side of the housing for the switches 18 is equal to that of each spacer 26. Furthermore, when a pair of holes 44 (See FIGS. 1 and 4) which extend through the housing so as to open to a top 19e and a bottom 19f (See FIG. 2) and are capable of accommodating the pair of supports 28 therewithin, are formed in the housing, each switch 18 may be firmly sandwiched between the base member 14 and the plate 22.

The plate 22 shown in the drawings consists of a disk having a diameter substantially equal to the distance between the opposite sidewalls 24 and is provided with a hole 45 (See FIG. 1) at a central portion thereof. Furthermore, four uniformly spaced-apart arcuate slots 46 are provided around the hole 45 in the circumferential direction. When the plate 22 is mounted upon the spacers 26, each slot 46 will have a portion thereof which aligns with the threaded hole 26a of each spacer 26. The plate 22 may be mounted on the base member 14 through means of screws 48 inserted through respective slots 46 from a position exterior to plate 22 into the corresponding threaded holes 26a so as to be spaced from the upper surface 14c of the base member and permitting the other end of the operating rod to extend therethrough.

The hole 45 is defined by means of a hole edge consisting of a straight portion 50 on each side of a square circumscribed by means of a circle. In the embodiment shown, the circle has a diameter slightly greater than that of the large-diameter tubular portion 36b of the tubular member of the operating rod 16 when in the non-pivotal state. The circle has a center on the axis A and four arcuate portions 52 connecting two adjacent straight portions 50. The distance between the axis A and each straight portion 50 is smaller than that between the axis A and each arcuate portion 52.

Each straight portion 50 has the same length. Each arcuate portion 52 has the same length and the same radius of curvature which is greater than that of the small-diameter tubular portion 36a of the tubular member of the operating rod such that the portion 36a is capable of contacting each arcuate portion. The length of each straight portion 50 is slightly greater than the length of each arcuate portion 52.

Figure 3:
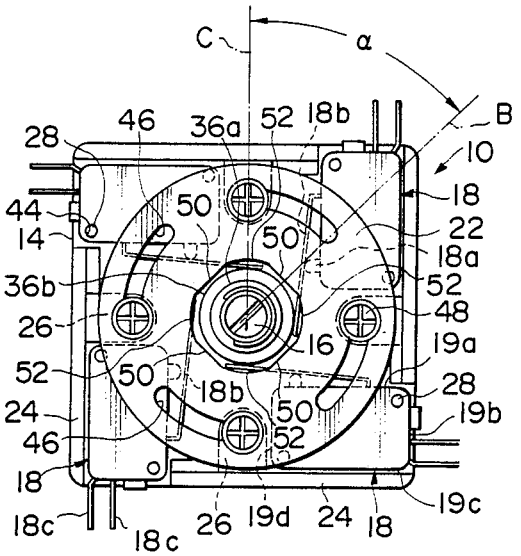
FIGS. 3 and 4 are plan views showing the switch assembly from which a mounting plate is omitted, when a plate is set at a specified position and when the plate is rotated through a predetermined angle from the specified position, respectively.

With each straight portion 50 and arcuate portion 52 adjacent to each other, an angle $\alpha$ made between a line B connecting the center of the circle on the axis A and the middle of each side portion 50 and a line C connecting the center on the axis A and the middle of each arcuate portion 52 is set to 45° (See FIG. 3). Furthermore, the opposite ends of each slot 46 present a semicircular shape having a diameter substantially equal to that of the shank of each screw 48. Respective centers of the semicircles at the opposite ends of each slot are positioned on the lines B and C.

Figure 4:
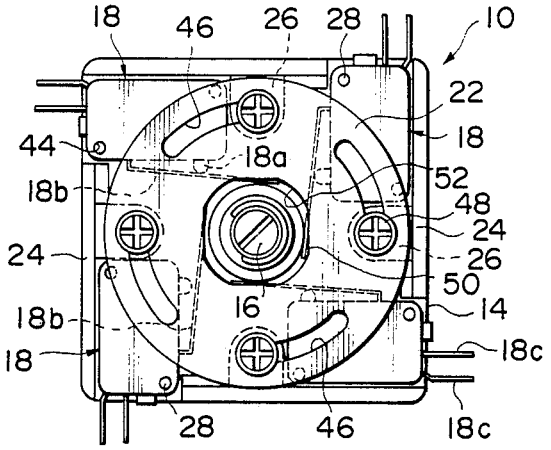

Therefore, by slightly loosening the screws 48, the plate 22 may be rotated about the axis A. Furthermore, by rotating the plate 22 until either one end of the slot contacts each screw 48, the plate 22 may be selectively positioned at a specified position as shown in FIG. 3 and a position as shown in FIG. 4, to which the plate is rotated through a predetermined angle, that is, 45° in the embodiment, from the specified position.

When the plate 22 is set at the specified position, each arcuate portion 52 of the hole edge corresponds to the free end of each actuator 18b and each straight portion 50 is positioned between two adjacent actuators 18b without corresponding to either free end thereof. At the specified position, when the operating rod 16 is pivoted toward one of the arcuate portions 52, the small-diameter tubular portion 36a contacts the arcuate portion 52 so as to stop the pivoting of the rod. At this time, however, the corresponding actuator 18b is completely depressed by means of the large-diameter tubular portion 36b so as to operate the switch 18. Furthermore, when the operating rod 16 is pivoted toward one of the straight portions 50, the small-diameter tubular portion 36a contacts the straight portion 50 so as to stop the pivoting of the rod. At this time, the large-diameter tubular portion 36b does not press against the adjacent actuators 18b so that both the switches 18 are not operated. More specifically, at the specified position, either one of the actuators 18b receives the pressing force of the operating rod 16 so as to permit the pivoting of the operating rod 16 to operate the corresponding switch 18.

On the other hand, when the plate 22 is rotated through a predetermined angle from the specified position, each straight portion 50 of the hole edge corresponds to the free end of each actuator 18b and each arcuate portion 52 is positioned between two adjacent actuators 18b without corresponding to either free end thereof. At this position, when the operating rod 16 is pivoted toward one of the straight portions 50, the small-diameter tubular portion contacts the straight portion 50 so as to stop the pivoting of the rod. At this time, however, each actuator 18*b* is completely pressed by the large-diameter tubular portion 36*b* so as to operate the corresponding switch 18. Furthermore, when the operating rod 16 is pivoted toward one of the arcuate portions 52, the small-diameter tubular portion 36*a* contacts the arcuate portion 52 so as to stop the pivoting of the rod. At this time, the large-diameter tubular portion 36*b* presses against the adjacent actuators 18*b* so as to operate the switches 18. More specifically, at this position, either one or two adjacent actuators 18*b* receive the pressing force of the operating rod 16 so as to permit the pivoting of the operating rod 16 to operate the corresponding switch or switches 18.

When four switches 18 are used, only the side portions of the square may be adopted without the arcuate portions 52. In this case, since a cross portion of the side portions does not regulate the pivoting of the operating rod but both the side portions regulate such pivotal movement, the distance through which the operating rod is capable of pivoting toward the cross portion is small, compared with the case when the arcuate portions are provided. In order to increase the distance, the diameter of the small-diameter tubular portion 36*a* may be made smaller or the length of each straight portion 50 may be made greater. Furthermore, each arcuate portion 52 may be made linear so as to be capable of contacting the small-diameter tubular portion 36*a* in a manner similar to the straight portion 50. Furthermore, slots 46 on the plate 22 may be provided on concentric circles, in lieu of on one circumferential circle. Furthermore, instead of the circular disk, a different planar shape, that is, polygonal disk may be used as the plate.

Obviously, many modifications and variations of the present invention are possible in light of the above teachings. It is therefore to be understood that within the scope of the appended claims, the present invention may be practiced otherwise than as specifically described herein.

What is claimed is:

1. A switch assembly comprising:

a base member provided with a through-hole;

an operating rod extending through said through-hole of said base member and pivotally supported upon said base member;

a plurality of switches mounted upon said base member which have respective actuators angularly and uniformly spaced apart along a circular locus having a center located upon the axis of said through-hole, either one or two adjacent actuators being capable of receiving a pressing force from said operating rod so as to actuate the corresponding switch or switches when said operating rod is pivoted; and a single plate rotatably mounted upon said base member about said axis of said through-hole between two operative positions and having a hole through which said operating rod extends, said hole of said single plate being defined by hole edge means for permitting pivoting of said operating rod such that only one of said actuators can receive a pressing force from said operating rod so as to actuate the corresponding switch operatively associated with said only one actuator when said plate is disposed at a first one of said two operative positions and for permitting pivoting of said operating rod such that either one or two adjacent actuators can receive a pressing force from said operating rod so as to actuate the corresponding switch or switches operatively associated with said either one or two adjacent actuators when said plate is rotated through a predetermined angle from said first operative position to said second operative position.

2. A switch assembly as claimed in claim 1, wherein:

the number of said switches is four; and said hole edge means of said plate comprises four straight portions defining the sides of a square which is circumscribed by means of a circle having its center disposed upon said axis of said through-hole, and four arcuate portions connecting two adjacent straight portions, an angle, defined by means of a line connecting the middle of each straight portion with said center of said circle and a line connecting the middle of each arcuate portion adjacent to said each straight portion with said center of said circle, being 45°.

3. A switch assembly as claimed in claim 2, wherein:

all of said straight portions of said hole edge means of said plate have the same length, and all of said arcuate portions have the same length and the same radius of curvature.

4. A switch assembly as claimed in claim 1, wherein said switches are disposed between said base member and said single plate.

5. A switch assembly as set forth in claim 1, further comprising:

spring biasing means disposed about said operating rod for returning said operating rod to its normally non-pivoted position.

6. A switch assembly as set forth in claim 2, wherein:

said base member has a substantially square-shaped configuration; and said four switches are disposed substantially within the four corner regions of said square-shaped base member.

7. A switch assembly as set forth in claim 1, further comprising:

sidewall means extending vertically upwardly from said base member;

said single plate is rotatably mounted upon said base member within the vicinity of the upper end of said sidewall means; and said plurality of switches are interposed between said base member and said single plate.

8. A switch assembly as set forth in claim 1, wherein:

said plurality of switches are of the automatic reset type.

9. A switch assembly as set forth in claim 1, further comprising:

mounting posts extending vertically upwardly from said base member;

fastening means secured within said mounting posts; and arcuate slot means defined within said single plate for engaging said fastening means of said mounting posts whereby said single plate is rotatably secured to said base member in such a manner as to achieve said two operative positions.

10. A switch assembly as set forth in claim 1, further comprising:

dowel mounting posts extending vertically upwardly from said base member; and aperture means defined within each one of said plurality of switches for receiving said dowel mounting posts whereby said plurality of switches are removably slideably mounted upon said dowel mounting posts of said base member.

11. A switch assembly as set forth in claim 10, wherein:

each of said plurality of switches comprises a substantially rectangular parallelepiped housing;

said aperture means are defined within diagonally opposite corners of said parallelepiped housings; and two dowel mounting posts are provided upon said base member for each one of said switches for mating engagement with said oppositely arranged aperture means of said switches.

12. A switch assembly, comprising:

a base member provided with a through-hole;

an operating rod extending through said through-hole of said base member and pivotably supported upon said base member;

a plurality of switches mounted upon said base member which have respective actuators angularly and uniformly spaced apart along a circular locus having a center located upon the axis of said through-hole, either one or two adjacent actuators being capable of receiving a pressing force from said operating rod so as to actuate the corresponding switch or switches when said operating rod is pivoted; and a single plate rotatably mounted upon said base member between two operative positions and having a hole defined therein, said hole having first edge portions defined at a first predetermined distance from the axis of said operating rod, and second edge portions defined at a second predetermined distance from said axis of said operating rod which is greater than said first predetermined distance of said first edge portions, such that when said single plate is rotatably disposed to a first one of said two operative positions, said second edge portions of said hole will be disposed at circumferential positions which correspond to those positions of said switch actuators whereby said switch actuators can only be actuated by said operating rod when said operating rod is moved substantially directly radially toward a particular one of said actuators, and said actuators are precluded from being actuated when said operating rod is moved radially to a position substantially between two adjacent actuators, while when said single plate is rotatably disposed to a second one of said two operative positions at which said first edge portions of said hole will be disposed at circumferential positions which correspond to those positions of said switch actuators, individual switch actuators can be actuated by said operating rod when said operating rod is moved substantially directly radially toward a particular one of said actuators and pairs of actuators can also be actuated when said operating rod is moved radially to a position substantially between a pair of adjacent actuators.

13. A switch assembly as set forth in claim 12, wherein:

said hole defined within said single plate has a substantially square-shaped configuration;

said first edge portions are linear portions defining the side edges of said substantially square-shaped hole; and said second edge portions are arcuate portions defining a circular locus circumscribing said substantially square-shaped hole, with said second edge portions being disposed substantially at the corners of said substantially square-shaped hole.

14. A switch assembly as set forth in claim 12, wherein:

said base member has a substantially square-shaped configuration; and said plurality of switches comprise four switches disposed substantially within the corner regions of said substantially square-shaped base member.

15. A switch assembly as set forth in claim 12, further comprising:

spring biasing means disposed about said operating rod for returning said operating rod to its normally non-pivoted position.

16. A switch assembly as set forth in claim 12, further comprising:

sidewall means extending vertically upwardly from said base member;

said single plate is rotatably mounted upon said base member within the vicinity of the upper end of said sidewall means; and said plurality of switches are interposed between said base member and said single plate.

17. A switch assembly as set forth in claim 12, further comprising:

mounting posts extending vertically upwardly from said base member;

fastening means secured within said mounting posts; and arcuate slot means defined within said single plate for operatively engaging said fastening means of said mounting posts whereby said single plate is rotatably secured to said mounting posts of said base member so as to achieve said two operative positions.

18. A switch assembly as set forth in claim 12, further comprising:

dowel mounting posts extending vertically upwardly from said base member; and aperture means defined within each one of said plurality of switches for receiving said dowel mounting posts whereby said plurality of switches are removably slideably mounted upon said dowel mounting posts of said base member.

19. A switch assembly as set forth in claim 18, wherein:

each of said plurality of switches comprises a substantially rectangular parallelepiped housing;

said aperture means are defined within diagonally opposite corners of said parallelepiped housings; and two dowel mounting posts are provided upon said base member for each one of said switch housings for mating engagement with said oppositely arranged aperture means of said switch housings.

20. A switch assembly, comprising:

a base member provided with a through-hole;

a plurality of mounting posts extending vertically upwardly from said base member;

a plurality of switches, having aperture means defined therein for slideably receiving said mounting posts of said base member whereby said plurality of switches are removably mounted upon said base member, including actuator means uniformly circumferentially spaced apart upon a circular locus which has its center concentric with the axis of said through-hole of said base member;

an operating rod extending through said through-hole of said base member and pivotably mounted upon said base member for selectively engaging said actuator means of said plurality of switches; and a cover plate fixedly secured to said base member with said plurality of switches interposed between said base member and said cover plate.

* * * * *